US005110129A

United States Patent [19]

Alvarez

[11] Patent Number: 5,110,129

[45] Date of Patent: May 5, 1992

[54] NUMBER SELECTING DEVICE AND PRINTING DEVICE AND PAMPHLET FOR PLAYING A LOTTERY

[76] Inventor: Miguel G. Alvarez, 7441 Northwest 8th St., Miami, Fla. 33126

[21] Appl. No.: 593,952

[22] Filed: Oct. 9, 1990

[51] Int. Cl.[5] ..... A63F 3/06

[52] U.S. Cl. ..... 273/138 A; 273/139; 283/903

[58] Field of Search ..... 273/138 A, 138 R, 139, 273/148 R; 283/903

[56] References Cited

U.S. PATENT DOCUMENTS

| | | | |
|---|---|---|---|
| 4,671,512 | 6/1987 | Bachman | 273/139 |
| 4,858,123 | 8/1989 | Alexoff et al. | 273/138 A |
| 4,871,172 | 10/1989 | Hwang | 273/138 R |
| 4,875,411 | 10/1989 | Turner | 273/138 A |

FOREIGN PATENT DOCUMENTS

| | | | |
|---|---|---|---|
| 2595261 | 9/1987 | France | 273/148 R |
| 0888155 | 12/1981 | U.S.S.R. | 273/138 A |

OTHER PUBLICATIONS

New Jersey Lottery, "Pick 6 Lotto", Lottery Ticket received in the PTO Jul. 27, 1991.

*Primary Examiner*—Benjamin Layno
*Attorney, Agent, or Firm*—Malloy, Downey & Malloy

[57] ABSTRACT

A number selecting device adapted to darken a predetermined amount of numbered boxes on a lottery computer game card inserted therein in accordance with a picked selection of numbers selected from a group of lucky numbers stored in a computer within the device wherein the lucky numbers are associated with a particular subject of interest to the user. Additionally, a pamphlet for use in playing a lottery comprising several cards including at least one lottery game card, the cards being attached to each other along a foldable seam wherein the seam attaching the game card is perforated to allow detaching and removal therefrom. The game card includes game panels printed thereon having the individually numbered boxes wherein a picked set of numbers are selected by darkening the boxes having numbers therein corresponding to the picked set for entry into a lottery drawing. The removable game card is adapted to be inserted into the number selecting device for darkening of the boxes and thereafter into a standard lottery computer card reading machine for printing of purchased game tickets and entry of the picked set of numbers into a memory bank.

20 Claims, 6 Drawing Sheets

NUMBER SELECTING DEVICE AND PRINTING DEVICE AND PAMPHLET FOR PLAYING A LOTTERY

BACKGROUND OF THE INVENTION

1. Field of the Invention

A device for selecting and darkening in a picked set of numbers on a lottery computer game card and a pamphlet for playing the lottery having detachable game cards adapted to be inserted into both the number selecting device and a standard lottery computer card reading machine for purchase of lottery tickets and entry of selected numbers into a lottery drawing.

2. Description of the Prior Art

Many states have adopted a state-wide lottery in which they have one or more lottery games. These games generally consist of either tickets which are purchased having a painted portion which can be scratched or rubbed away to reveal a combination or other insignia indicating to the purchaser whether or not he or she is an instant winner. Additionally, many states have at least one lottery drawing, generally held once a week, wherein a predetermined amount of numbers are drawn from a larger group of numbers, wherein the drawn numbers represent a winning combination. To participate in this type of lottery drawing, players usually are required to fill out a computer type card having numbered boxes thereon having the larger group of numbers individually placed within each box. The player makes a selection of picked numbers to be entered into the drawing by darkening-in an amount of boxes for each game corresponding with the amount of numbers to be drawn in the drawing. The numbers within each box which is darkened by the player, represent the picked combination of numbers which to be entered into the drawing. The player is then required to purchase lottery game tickets by presenting the computer card to an authorized lottery ticket dealer. The lottery ticket dealer inserts the computer card into a computerized lottery card reading device which is adapted to detect the darkened boxes corresponding with the numbers picked and thereafter, enters the picked selection of numbers into a central memory bank. Additionally, the computer card reading device prints out a lottery ticket having the picked number combination representing the player's entry into the drawing. The printed game ticket represents a receipt for use by the player as proof that he or she has paid for and entered a selection of numbers into the drawing. A player wins by matching some or all of the picked numbers on his purchased lottery ticket with the winning combination of numbers drawn in the lottery drawing. Upon presentation of the purchased ticket at either an authorized lottery ticket dealer or the Lottery Commission enables the player to collect his prize.

The wide-spread popularity of these state lottery drawings has led to numerous number picking devices which are adapted to select numbers for a player to be entered into the drawing. Often, many people who play these lottery games often pick numbers which they feel are of some personal significance to them. Commonly, many people will pick birth dates of close relatives as their selected combination for entry into the drawing. Additionally, many people select numbers which they have found to be lucky to them over their lives. These lucky numbers may relate to dates of past events or may be numbers which have some significant meaning in the person's life and, accordingly, the person has labeled the number as a "lucky number".

In playing the lottery, people will often use these "lucky numbers" in making their picked selection of numbers for entry into the lottery drawing. However, often people do not have "lucky numbers" or they want to play several games and do not have enough numbers to make several different picked selections. In this situation, the person playing the lottery usually just makes random selections on the computer card by darkening in the designated amount of numbers for each game, wherein the pick selection has no significant meaning through the player. Because most people make their selections in the establishment selling the lottery tickets, they do not have time to resort to various number selecting devices or other sources of "lucky numbers" which may have some significant meaning to the individual player.

Accordingly, there is a need in the lottery industry for a number selecting device adapted to darken a predetermined selection of numbered boxes on a computer lottery game card wherein the numbers selected correspond with "lucky numbers" associated with the user.

Additionally, there is a need in the lottery art for a pamphlet having removable computer game cards for purchasing lottery tickets and entry of selected numbers in a lottery drawing wherein the pamphlet further includes information therein relating to "lucky numbers" or other such information which may be of interest to the individual playing the lottery.

SUMMARY OF THE INVENTION

The present invention relates to a device for automatically selecting numbers to be entered in a lottery drawing and a pamphlet for use in playing the lottery. The pamphlet includes a plurality of cards including at least one lottery game card for use in making a pick selection for entry into a lottery computer and purchase of tickets. Each of the cards of the pamphlet is attached with an adjacent card along adjacently positioned side edges defining a seam therealong. .Each of the seams attaching adjacent cards is structured so as to allow the cards to be folded between an open position and a closed position with the cards disposed in overlying, stacked relation to one another. The seams attaching the game cards to the pamphlet are preferably perforated so as to allow the game cards to be removably detached from the pamphlet for insertion within a standard lottery computer card reading machine.

Each of the game cards includes a printed format thereon generally resembling that of a standard lottery computer card used for entering numbers into the drawing and purchasing of lottery tickets. Additionally, the pamphlet may have several game cards each being used for a particular lottery drawing held by the particular state. Normally, the game card would include several panels wherein each panel includes numbered boxes, numbered consecutively from 1 through the total number of numbers in the drawing. An entry is made by darkening in a predetermined amount of numbers in the boxes in accordance with the amount of numbers drawn in the lottery drawing. Each panel on the game card is used for making an entry of a picked selection of numbers wherein a single lottery ticket can be purchased for each panel that the player has darkened the boxes on. The game card is then given to an authorized lottery ticket dealer who inserts the card into a computer which scans the card and enters the picked selection of numbers on each panel into a central memory bank. The lottery computer additionally prints out tickets corresponding with the number of panels filled in on the game card which the player retains as a receipt indicating that he has paid for the entry of his picked selections into the drawing.

In order to assist the player in making his picked selection of numbers for each game, the pamphlet includes at least one card, other than a game card, which includes certain information which is relevant to making a picked selection of numbers for entry into the drawing. The information on this card may relate to numbers which have been found to be closely associated with the zodiac sign of the player. In this instance, the information card might have a pool of numbers which have been found to have been drawn in past lottery drawings during the time period associated with that particular zodiac sign. Accordingly, these numbers would be considered as "lucky numbers" for a person having that particular zodiac sign.

Additionally, the game cards in the pamphlet may include at least one of the game panels having pre-darkened boxes representing predetermined picked set of numbers for purchase of a lottery ticket and entry of the picked set into the drawing. This pre-determined picked set of numbers, represented by the pre-darkened boxes, might reflect certain lucky numbers associated with the player, such as lucky zodiac numbers. In any event, the pre-darkened selections entered on at least one of the game panels of the game card represents a "quick pick" wherein the player is not required to have to darken the boxes with a writing instrument such as a pen or pencil. In this manner, the player can simply remove the game card from the pamphlet and hand it over to the authorized lottery ticket dealer for purchase of at least one lottery ticket and entry of the numbers in the drawing without having to physically darken in the boxes with a writing instrument such as a pen or a pencil. Accordingly, if the player is in a hurry or a pen or pencil is not available, he can simply remove from the pamphlet the game card having the pre-darkened "quick pick" selections thereon for quick and efficient purchase of a lottery ticket for entry into the lottery drawing.

Alternatively, the game card can be removed from the pamphlet and inserted into a number selecting device which is adapted to darken the predetermined number of boxes in accordance with a predetermined selection or a random selection representing an alternative method of obtaining a "quick pick" selection of numbers. The numbers selected by the number selecting device may be simply random selections or they might be "lucky numbers" somehow associated with the player.

A primary feature of the present invention is the number selecting device which is adapted to darken the predetermined number of numbered boxes on a computer lottery game card which is subsequently entered into the lottery computer for purchasing lottery tickets. The number selecting device normally comprises a housing with an exterior casing and a receiving slot formed therein for insertion of the computer lottery game card. To operate the device, the user would simply select a subject, whether it be related to sports, horoscope, birth dates, or the like, and enter it on an entry panel affixed to the outer casing of the device. Within the casing, a computer memory bank stores groups of "lucky numbers" which are associated with various subjects from which the user made his initial selection. Once having inserted the computer game card within the slot of the housing and additionally having made the subject entry, the deice would automatically select a selection of numbers from the group of numbers associated with the subject period. The selection of numbers, whether it be a predetermined selection or a random selection, would then be transmitted to a printing means which is adapted to darken the correspondingly numbered boxes which correspond within the selection of numbers. These darkened boxes of the number selection represent the picked set of numbers or "quick pick" selection to be entered into the lottery drawing.

The invention accordingly comprises the features of construction, combination of elements, and arrangement of parts which will be exemplified in the description hereinafter set forth and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
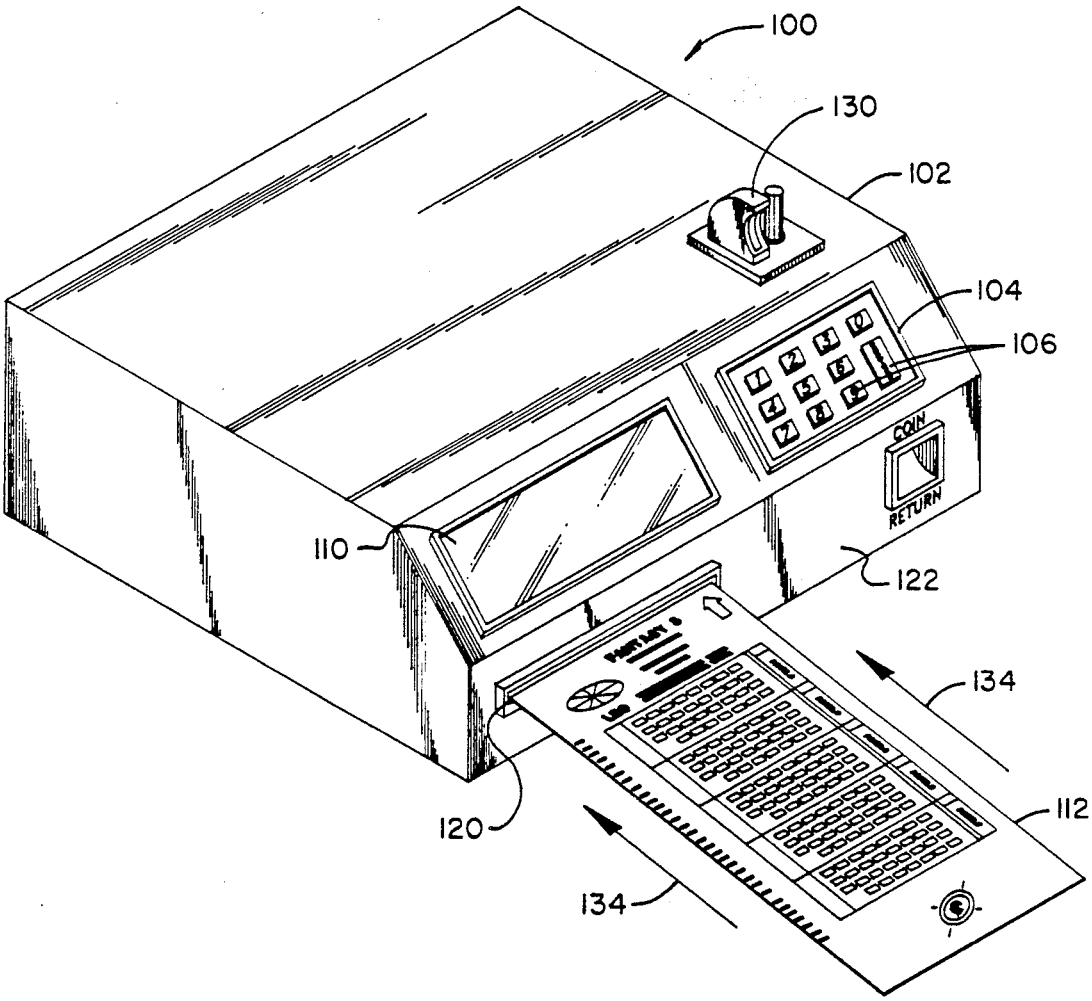
FIG. 1 is a perspective view illustrating a preferred embodiment of the number selecting device of the present invention showing a computer game card being inserted therein.
Figure 2:
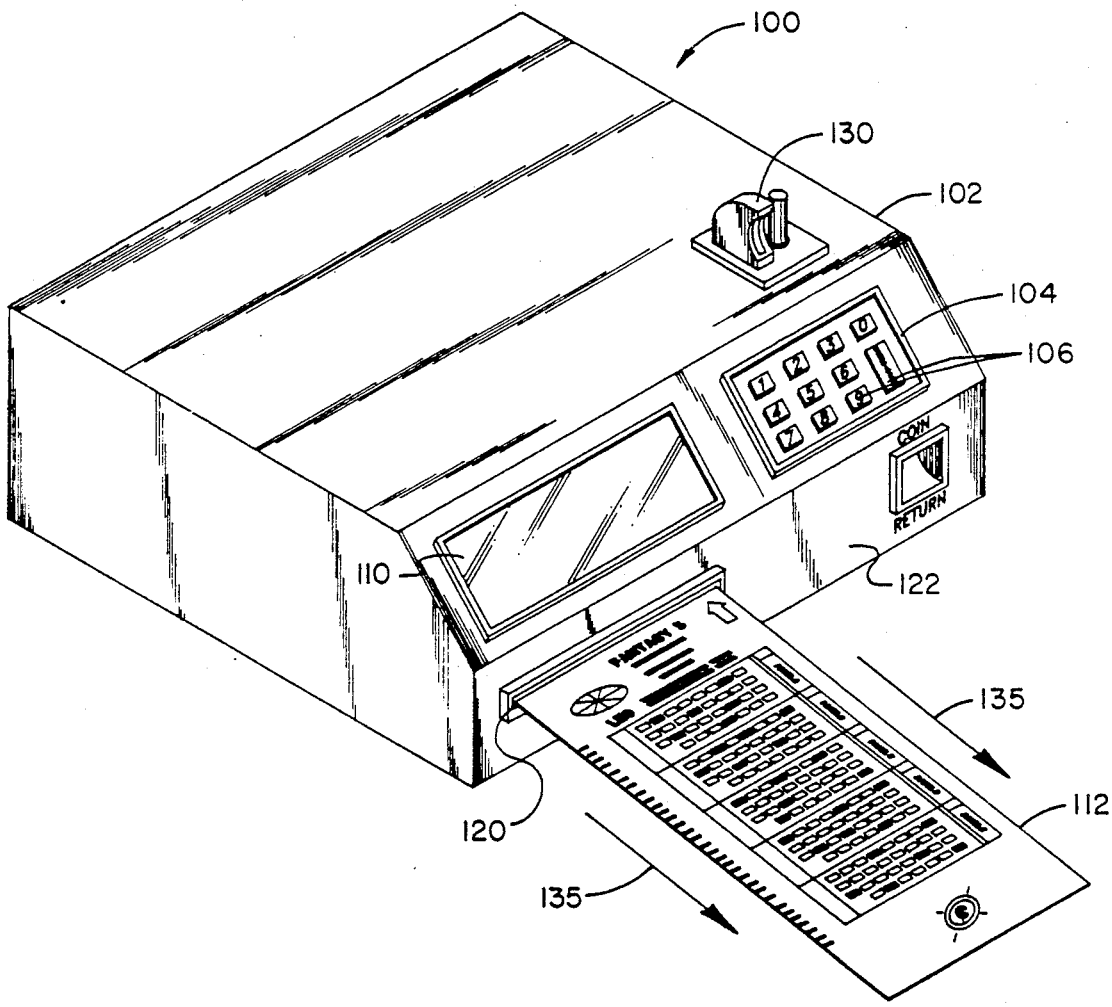
FIG. 2 is a perspective view of the number selecting device of FIG. 1 illustrating the computer game card being ejected from the number selecting device having a predetermined selection of boxes darkened on each game panel.
Figure 3:
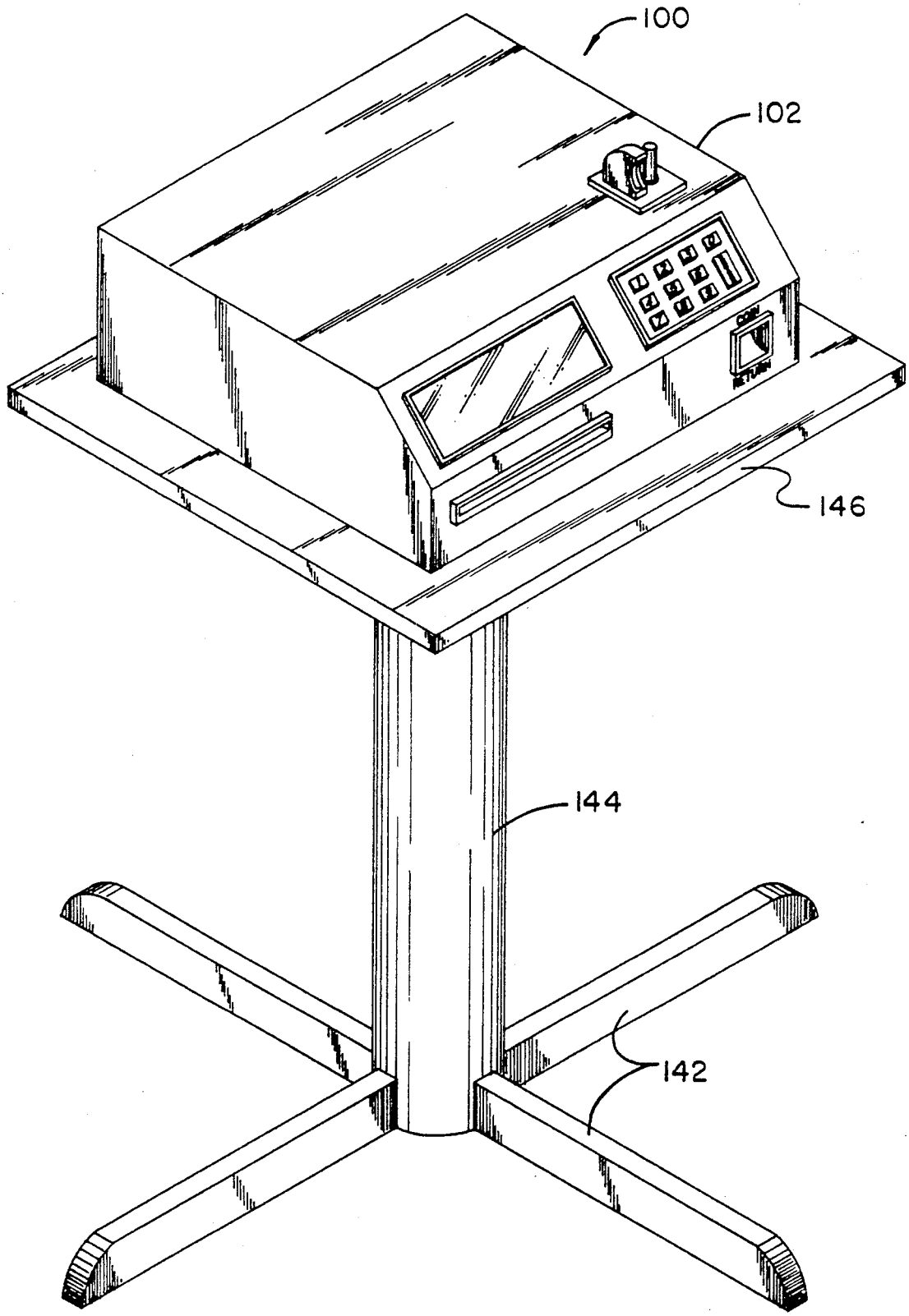
FIG. 3 is a perspective view of the number selecting device of FIG. 1 mounted on a pedestal.
Figure 3A:
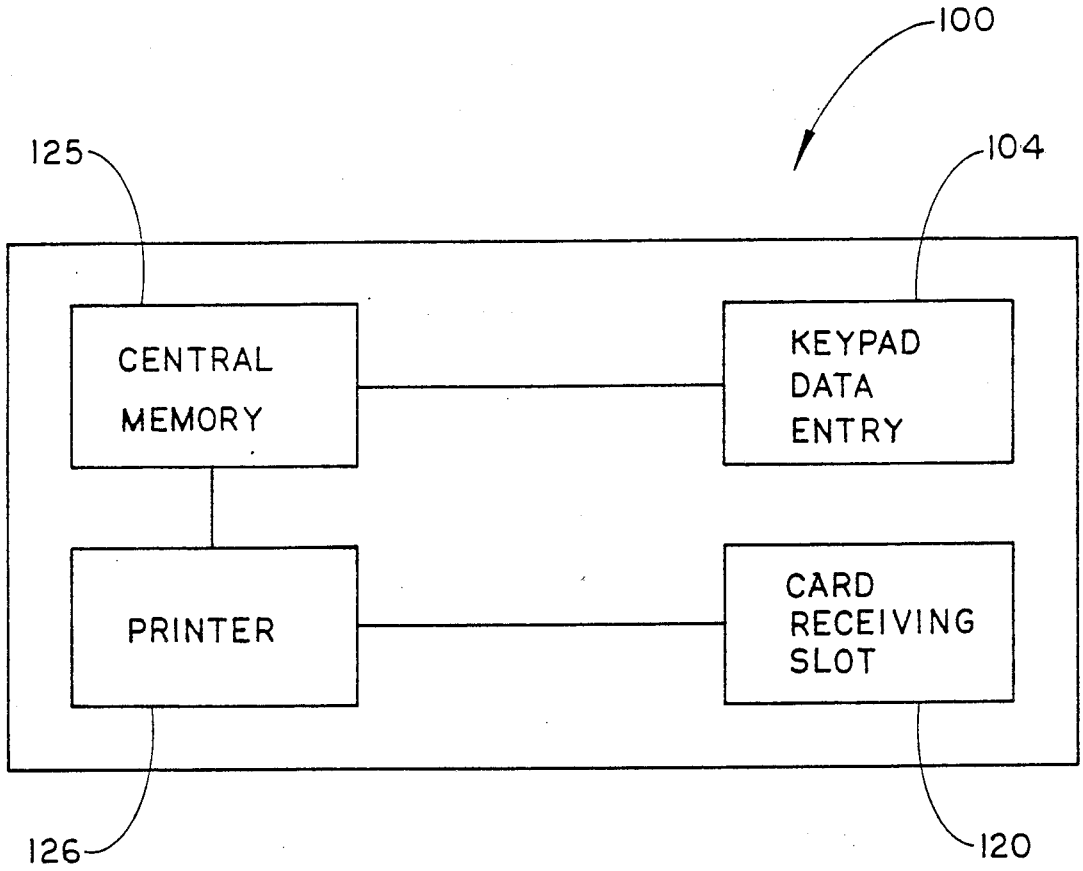
FIG. 3A is a schematic illustrating the principal components of the number selecting device of FIGS. 1-3.

As illustrated in FIGS. 1 through 3, the present invention is directed to a number selecting device, generally indicated as 100, for making a picked selection of numbers from a group of numbers for entry into a lottery drawing. The picked selection of a predetermined amount of numbers are chosen from a group of numbers relating to particular subjects chosen by the user.

The user chooses the subject by entering data into a computer within the housing 102 of the device 100 using the buttons 106 on the keypad 104. The subjects chosen generally relate to some matter of interest to the user, such as horoscope, sports, ancient Kabala, etc., wherein a group of lucky numbers associated with the particular subject are stored in the memory of the computer. When the user pushes the buttons 106 in accordance with instructions appearing on the display screen 110, the computer picks the picked selection from the group of lucky numbers associated with the subject chosen.

A card receiving slot 120 is located on a front side 122 of the housing 102 being specifically designed for receipt of a standard computer lottery game card 112 used for punching lottery tickets in a particular state.

In use, a user would deposit money in the coin slot 130, or other similar money receiving means, to activate the device 100. Instructions on the display screen 110 direct the user as to which of the buttons 106 to push. The computer game card 112 is then inserted into the card slot 120, as indicated by the arrows 134 in FIG. 1. After the user has chosen the subject in accordance with the instructions on the display screen 110, the computer picks the picked selection of a predetermined amount of numbers from the lucky group of numbers associated with the chosen subject from the computer memory bank 126. These picked numbers are then printed on the computer card by printer 126 which darkens in a corresponding amount of boxes having the particular picked selection of numbers therein, as seen in FIG. 2. The computer card 112 is then ejected from the card slot 120, in the direction of arrows 135, whereupon the user can then present the game card 112 to an authorized lottery ticket dealer.

As seen in FIG. 3, the device 100 may be mounted on a pedestal 140 or like structure adapted to support the housing at a preferred operating height. The pedestal preferably includes a supporting base 142 extending out from the bottom of a vertical support pole 144. A support platform 146, adapted to support the device 100 thereon, is attached to an opposite upper end of the vertical pole 144.

The preferred embodiment of the present invention includes a pamphlet generally indicated as 10 for use in playing a lottery as commonly done by many states throughout the country. The pamphlet 10 includes a plurality of cards, including game cards 12 and 12' and at least one information card 14 which contains information relevant to the selection of numbers to be entered in a lottery drawing.

Figure 4:
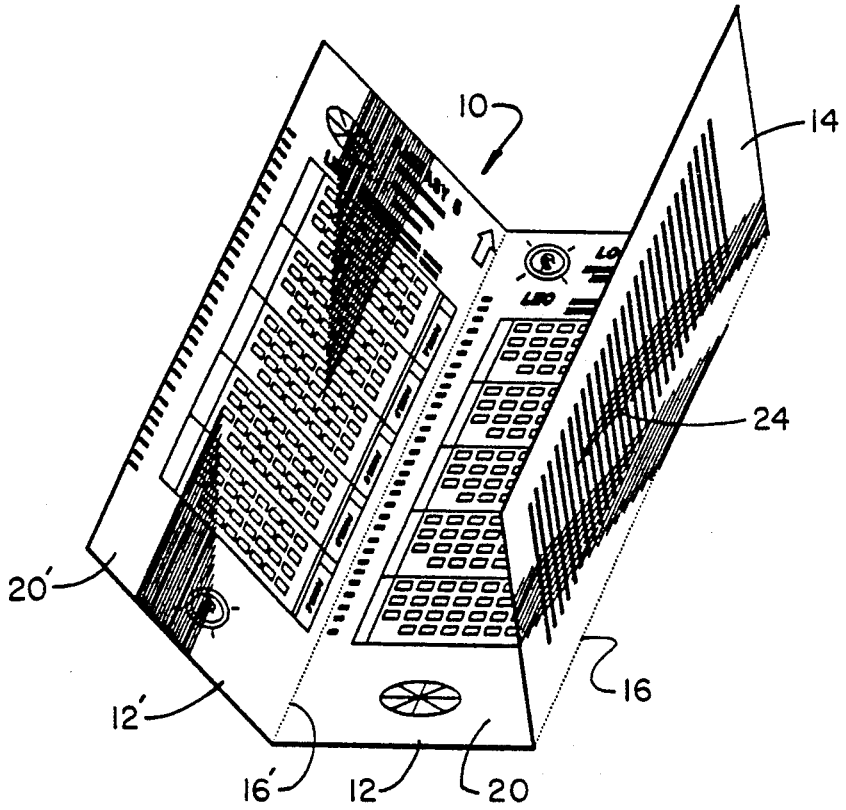
FIG. 4 is a perspective view of a preferred embodiment of the pamphlet of the present invention.
Figure 5:
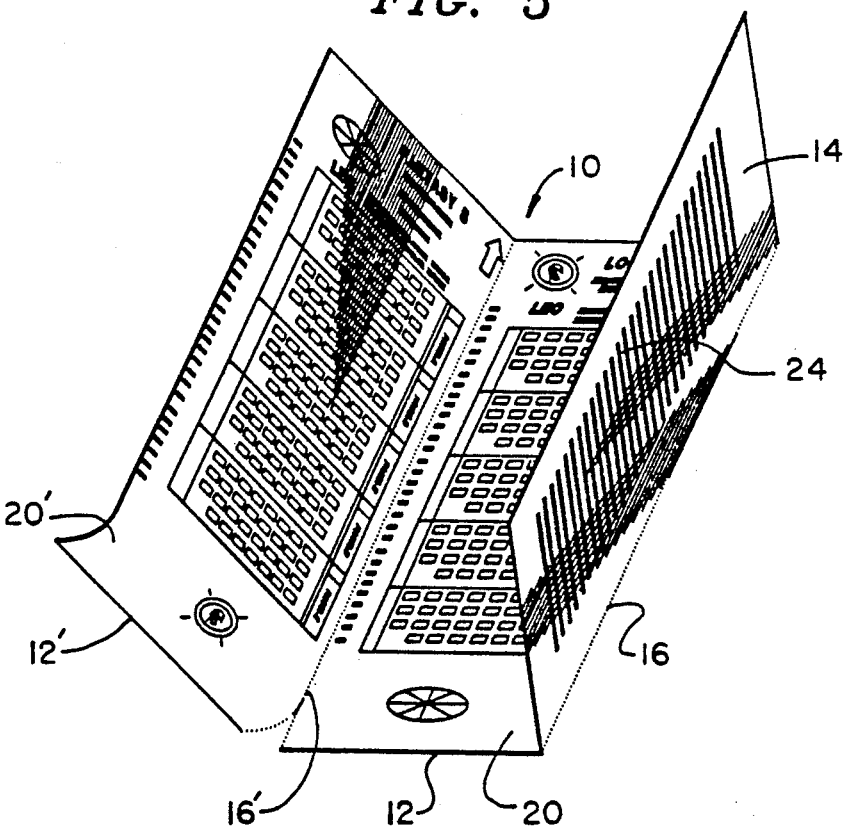
FIG. 5 is a perspective view of the pamphlet of FIG. 1 illustrating a game card being detachably removed therefrom.

Each of the cards is attached to an adjacent card along a seam 16 and 16'. Each of the seams 16 and 16' are structured so as to facilitate folding therealong so that the cards can be foldably moved between an open position and a closed position, Wherein the cards are disposed in overlying, stacked relation to one another. The seams attaching the game cards 12 and 12' to the remaining cards in the pamphlet are preferably perforated, as indicated by the dotted line in FIGS. 4 and 5, so as to facilitate detaching therealong for removal of the game card from the rest of the pamphlet. In this manner, the game card is adapted to be inserted into a standard lottery computer card reading device in the same manner as lottery computer cards known in the related art. The lottery computer card reading device would thus detect which numbers were picked as selections in one or more games for entry into a central lottery memory bank. Additionally, the lottery computer card reading device would issue lottery tickets in the same manner as done when using standard computer lottery entry cards.

Accordingly, each of the game cards 12 and 12' includes a first main face 20 and 20' having printed matter thereon arranged in such a manner as to facilitate the selection and entry of picked number selections thereon to be fed into the lottery computer for purchase of lottery tickets. Additionally, the information card 14 includes printed information 24 thereon which may be relevant to the selection of certain "lucky numbers" to be entered into a lottery drawing by the person using the pamphlet 10. This printed information 24 may include data or other information which is relevant to the person using the pamphlet, such as information relating to the person's horoscope. This printed information 24 may include a pool of numbers which is representative of "lucky numbers" associated with a person's particular zodiac sign. Alternatively, this printed information 24 may include "lucky numbers" somehow associated with the particular person who is using the pamphlet.

Figure 6:
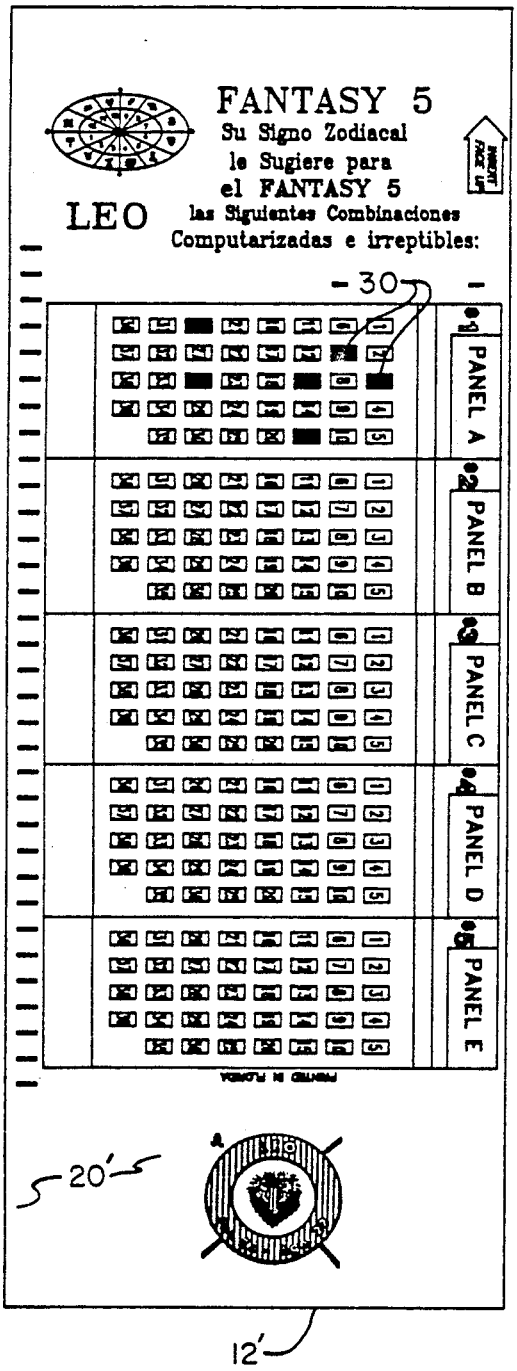
FIG. 6 is a plan view of the face of a game card for use in making a purchased entry of numbers in a lottery drawing.
Figure 7:
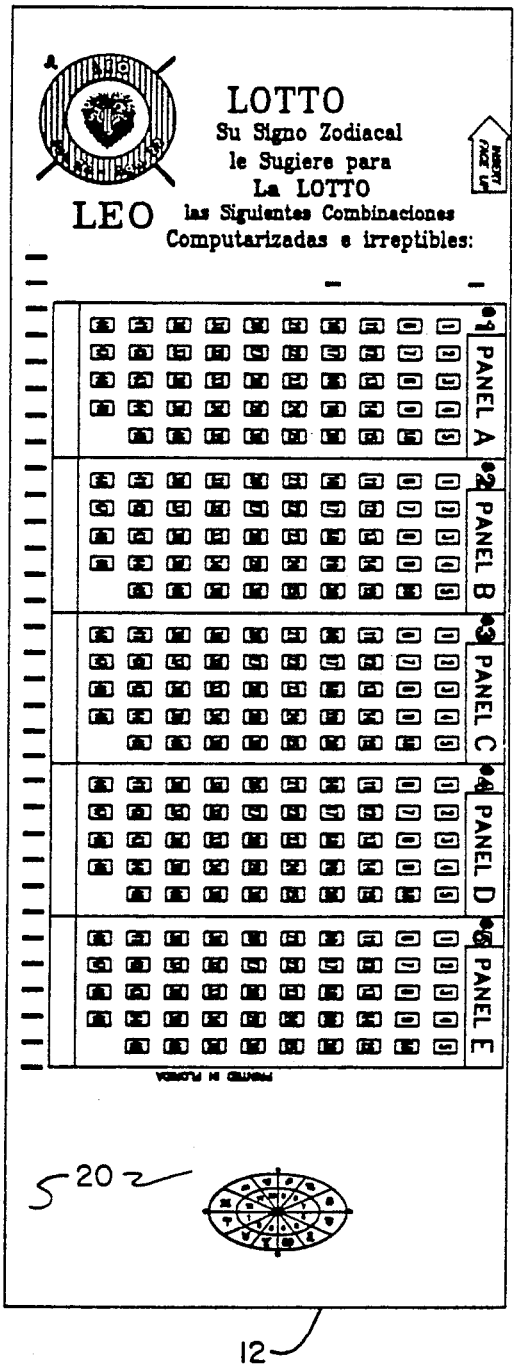
FIG. 7 is a plan view of the face of an alternative game card for use in making a purchased entry of numbers in a different lottery drawing.

As seen in FIGS. 6 and 7, the first main faces 20 and 20' of the game cards 12 and 12' include a printed layout generally representing a computer lottery entry card for purchasing and entering a picked selection of numbers into a lottery drawing. While these game cards 12 and 12' as shown in FIG. 7 are representative of one type of lottery computer entry card used in playing a particular state lottery, other variations and forms may be used so long as they are compatible for use with the particular state's lottery computers. As seen on the game cards 12 and 12' in FIGS. 6 and 7, the first main surfaces 20 and 20' include a printed array of game panels labeled panels A–E wherein each panel is used for making selected picked number combination entries for between 1 and 5 games.

A picked selection of numbers to be entered for each game played is made by darkening in a predetermined amount of the boxes such as 30 wherein the lottery computer senses the darkened boxes and enters the corresponding numbers therefore into the central memory bank. These boxes may be either darkened in by the player using an ordinary writing instrument such as a pen or a pencil or they may be pre-darkened when printing the game cards 12 and 12'. Alternatively, the darkened boxes 30 may be darkened by use of a number selecting device adapted to darken in a picked selection of boxes corresponding with either a random selection of picked numbers or a predetermined selection of picked numbers.

In use, the game cards 12 and 12' would be detachably removed from the pamphlet 10 by tearing along the perforated seams 16 and 16' preferably after the selections have been made by darkening the boxes. At this point, the game cards can be given to an authorized lottery ticket dealer when the game cards would be inserted in the appropriate lottery computer for purchase and entry of a picked selection of numbers for one or more games. The numbers selected 30, either by the player or by other means such as a number selecting device, would preferably be somehow associated with the person using the pamphlet.

Now that the invention has been described, what is claimed is:

1. A device for darkening boxes on a computer lottery game card for use in purchasing lottery tickets; the device comprising:

a housing including an outer casing, a slot formed in said housing structured and configured for entry of the lottery game card therein, memory means within said housing adapted to store a plurality of groups of numbers, wherein an individual group of numbers corresponds with a corresponding particular subject, means on the exterior of said outer casing for selecting and entering said subject, number selecting means adapted to select a selection of numbers from said group of numbers corresponding with the entered subject, and printing means adapted to darken in those boxes on the computer lottery game card having said selection of numbers printed therein.

2. The device as in claim 1 further comprising means for depositing money therein in order to activate said device.

3. The device as in claim 1 further comprising a supporting pedestal structured and configured for mounting said device thereon.

4. A pamphlet for use in playing a lottery of the type wherein a winning set of numbers are drawn from a group of numbers of a predetermined amount, the pamphlet comprising:

a plurality of cards each having a pair of opposite main faces including a first main face and a second main face, each of said plurality of cards attached to an adjacent positioned card along correspondingly positioned, adjacent side edges, defining a seam therealong, said plurality of cards including at least one game card for use in playing the lottery, said game card being detachable along said seam so as to facilitate removal from the pamphlet, each one of said game cards including a plurality of game panels printed on at least one of said opposite main faces, each of said game panels including a group of numbers arranged in a series of rows of boxes, at least one of said plurality of cards including informative or other printed material on at least one of said opposite main faces relating to the manner of playing the lottery and providing assistance and guidance in selecting numbers to be indicated on the game card for entry in the lottery, a computerized number selecting means adapted to select a predetermined selection of numbers to be entered into the lottery, computerized said number selecting means also adapted to darken a set of boxes corresponding to said predetermined selection of numbers and said computerized number selecting means including a computerized game card reading device structured to detect said darkened corresponding set of boxes and to enter said predetermined selection of numbers into a central memory bank for entry into the lottery drawing, and said computerized game card reading device is further structured to print individual game tickets having said predetermined selection of numbers printed thereon for retaining as a receipt by a player and said game card being printed with at least one selection of numbers to be entered into the lottery thereon.

5. A pamphlet as in claim 4 wherein each of said seams are structured and disposed to allow folding therealong so as to permit said plurality of cards to be movable between an open position defined by said panels disposed in adjacent, co-planar relation and a closed position defined by said panels disposed in overlying, stacked relation to one another.

6. A pamphlet as in claim 4 wherein at least one of said seams is structured to permit detachment of said game card therealong for removal from the pamphlet.

7. A pamphlet as in claim 6 wherein said one seam is perforated along its length so as to permit separation and detachment of said game card therealong for removal from the pamphlet.

8. A pamphlet as in claim 6 wherein all of said seams are perforated along their respective lengths so as to permit separation and detachment of each of said plurality of cards therealong for individual removal from the pamphlet.

9. A pamphlet as in claim 6 wherein said plurality of cards of the pamphlet include a plurality of game cards.

10. A pamphlet as in claim 9 wherein each one of said game cards is adapted to be used for selecting a picked set of numbers for entry into a lottery drawing for matching with a winning set of numbers drawn from a group of numbers from a predetermined amount.

11. A pamphlet as in claim 10 wherein each one of said game cards includes a plurality of game panels printed on at least one of said opposite main faces, each of said game panels including an arrangement of said group of numbers wherein a predetermined playing amount of said numbers selected from said group make up said picked set for entry into the lottery drawing.

12. A pamphlet as in claim 11 wherein said game panels each include a series of rows of boxes printed on one of said opposite main faces with said group of numbers being individually and separated printed within individual ones of said boxes in consecutive order.

13. A pamphlet as in claim 4 wherein the darkening of said corresponding set of boxes is done by said player using a writing instrument.

14. A pamphlet as in claim 13 or 4 wherein said game cards in the pamphlet are printed with at least one of said game panels having said corresponding set of boxes pre-darkened.

15. A pamphlet as in claim 4 wherein said game cards in the pamphlet include a variety of specialized cards each being independently adapted for use in a different lottery drawing.

16. A pamphlet as in claim 4 wherein said game cards in the pamphlet include a variety of specialized cards each being independently adapted for use in a different lottery drawing.

17. A method of playing the lottery of the type wherein a winning set of numbers is selected in a lottery drawing, the method comprising the steps of:

selecting a picked set of numbers of a predetermined amount from a group of numbers for entry into the drawing, darkening a corresponding set of boxes on a game card contained in a pamphlet wherein each of said darkened boxes has a corresponding one of said picked set of numbers therein, detaching said game card from the pamphlet, inserting said game card into computerized game card reading device adapted to detect said darkened boxes and enter said picked set into a central memory bank, said steps of selecting and darkening including printing said game cards with at least a portion of said corresponding set of boxes pre-darkened, and said step of selecting including picking said picked set from a pool of numbers printed on the pamphlet.

18. A method as in claim 17 wherein the steps of selecting and darkening include inserting said game card into a number selecting device adapted to randomly darken said corresponding set of boxes.

19. A method as in claim 17 wherein the steps of selecting and darkening include inserting said game card into a number selecting device adapted to darken said corresponding set of boxes in accordance with a predetermined selection of said picked set.

20. The method as in claim 17 wherein said step of darkening is performed by a lottery player using a writing instrument.

* * * * *